US010737516B2

(12) United States Patent
Mueller

(10) Patent No.: US 10,737,516 B2
(45) Date of Patent: Aug. 11, 2020

(54) PRINT HEAD ADJUSTMENT DEVICE

(71) Applicant: HEIDELBERGER DRUCKMASCHINEN AG, Heidelberg (DE)

(72) Inventor: Andreas Mueller, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/252,071

(22) Filed: Jan. 18, 2019

(65) Prior Publication Data

US 2019/0255867 A1 Aug. 22, 2019

(30) Foreign Application Priority Data

Feb. 22, 2018 (EP) ..... 18158032

(51) Int. Cl.

| | |
|---|---|
| ***B41J 29/38*** | (2006.01) |
| ***B41J 25/304*** | (2006.01) |
| ***B41J 2/155*** | (2006.01) |
| ***B41J 25/00*** | (2006.01) |
| ***B41J 25/34*** | (2006.01) |
| ***B41J 25/316*** | (2006.01) |

(52) U.S. Cl.

CPC ..... *B41J 25/304* (2013.01); *B41J 2/155* (2013.01); *B41J 25/001* (2013.01); *B41J 25/003* (2013.01); *B41J 25/316* (2013.01); *B41J 25/34* (2013.01); *B41J 29/38* (2013.01); *B41J 2202/19* (2013.01); *B41J 2202/20* (2013.01); *B41J 2202/21* (2013.01)

(58) Field of Classification Search

CPC ..... B41J 29/377
USPC ..... 347/8
See application file for complete search history.

(56) References Cited

U.S. PATENT DOCUMENTS

2008/0238959 A1* 10/2008 Kato ..... B41J 11/007 347/8
2009/0244124 A1 10/2009 Kondo
2012/0182336 A1* 7/2012 Itoh ..... B41J 3/28 347/8

FOREIGN PATENT DOCUMENTS

DE 102016209945 A1 1/2017
DE 102016214253 A1 2/2018

* cited by examiner

*Primary Examiner* — Lam S Nguyen
(74) *Attorney, Agent, or Firm* — Laurence A. Greenberg; Werner H. Stemer; Ralph E. Locher

(57) ABSTRACT

A device for adjusting print heads, in particular inkjet print heads of an inkjet printing machine, on a print bar includes motors disposed in a row and supported for joint movement. Every motor carries a motor gearwheel and every motor gearwheel is successively engageable with at least two respective adjustment gearwheels.

9 Claims, 3 Drawing Sheets

PRINT HEAD ADJUSTMENT DEVICE

CROSS-REFERENCE TO RELATED APPLICATION

This application claims the priority, under 35 U.S.C. § 119, of European Patent Application EP 18 158 032.5-1019, filed Feb. 22, 2018; the prior application is herewith incorporated by reference in its entirety.

BACKGROUND OF THE INVENTION

Field of the Invention

The present invention relates to a device for adjusting print heads on a print bar.

Print bars are used to print page-wide prints, for example in inkjet printing. A print bar typically includes a row of print heads that need to be adjusted relative to one another.

German Patent Application DE 10 2016 209 945 A1 uses different terminology for print bars and print heads. In that document, the print bar is called a print head and the print heads are called modules. Every module includes an adjustment device for adjusting the modules relative to one another and a carriage is provided. The carriage is successively movable to the modules and includes an actuating device for actuating the adjustment devices. In order to move the carriage from one module to another, a first motor drives a driving spindle for driving the carriage. Every module has an adjustment spindle supporting an adjustment wheel. By adjusting the carriage into a position opposite a module to be adjusted, the driving wheel is brought into meshing engagement with the adjustment wheel. Once the teeth mesh, the driving wheel may drive the adjustment wheel to adjust the module. A disadvantage is that an adjustment of all modules takes a long time. Since all modules are adjusted successively by a single common carriage, the entire adjustment process is very time-consuming.

SUMMARY OF THE INVENTION

It is accordingly an object of the invention to provide a print head adjustment device, which overcomes the hereinafore-mentioned disadvantages of the heretofore-known devices of this general type and which provides short set-up times.

With the foregoing and other objects in view there is provided, in accordance with the invention, a device for adjusting print heads on a print bar, comprising motors disposed in a row and supported to be jointly movable, with every motor carrying a motor gearwheel and every gearwheel successively engageable with at least two respective adjustment gearwheels.

An advantage of the device of the invention is that it allows a plurality of print heads to be adjusted simultaneously and in parallel. This reduces set-up times.

Various further developments are possible:

- The motors may be supported on a rail, the at least two adjustment gearwheels may be disposed in a row of adjustment gearwheels and the rail may be supported for movement in parallel with the row of adjustment gearwheels.
- A drive may be provided to move the rail.
- The at least two adjustment gearwheels may respectively be disposed on a screw and the screws may be oriented in parallel with one another.

- The screws may have a cone that forms an advance wedge.
- Multiple locking mechanisms may be provided to lock the at least two adjustment gearwheels in angular positions.
- For this purpose, the screws may have depressions and pressure elements may be provided to form the multiple locking mechanisms together with the depressions.
- The number of depressions of the multiple locking mechanisms may preferably correspond to the number of teeth of the at least two adjustment gearwheels.
- In a concomitant development, the axial length of the toothing of every motor gearwheel supported by the motors is greater than every one of the at least two adjustment gearwheels. The print heads are preferably inkjet print heads.

Other features which are considered as characteristic for the invention are set forth in the appended claims.

Although the invention is illustrated and described herein as embodied in a print head adjustment device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
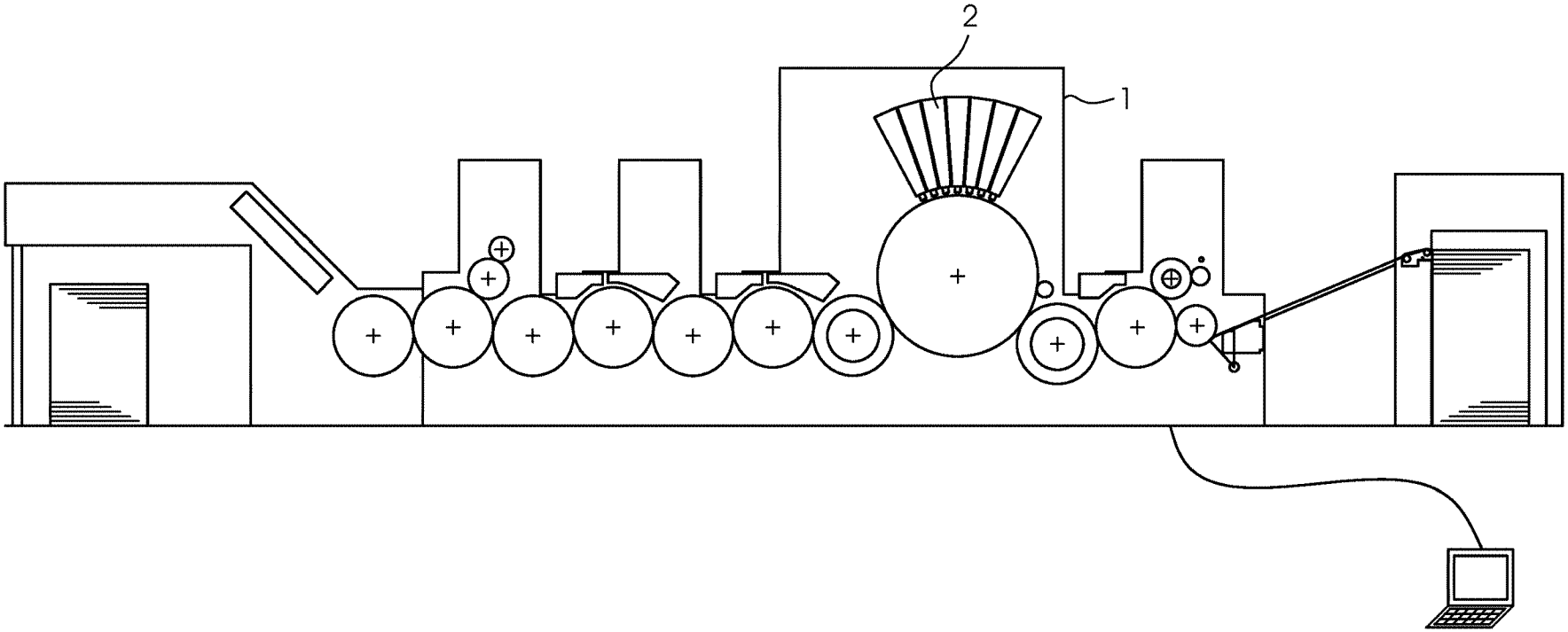
FIG. 1 is a diagrammatic, overall, longitudinal-sectional view of a printing machine.

Referring now in detail to the figures of the drawings, in which mutually corresponding elements have the same reference symbols, and first, particularly, to FIG. 1 thereof, there is seen a printing machine 1 having multiple print bars 2 of identical construction. Every print bar 2 prints a page-wide inkjet print in a different color.

Figure 2:
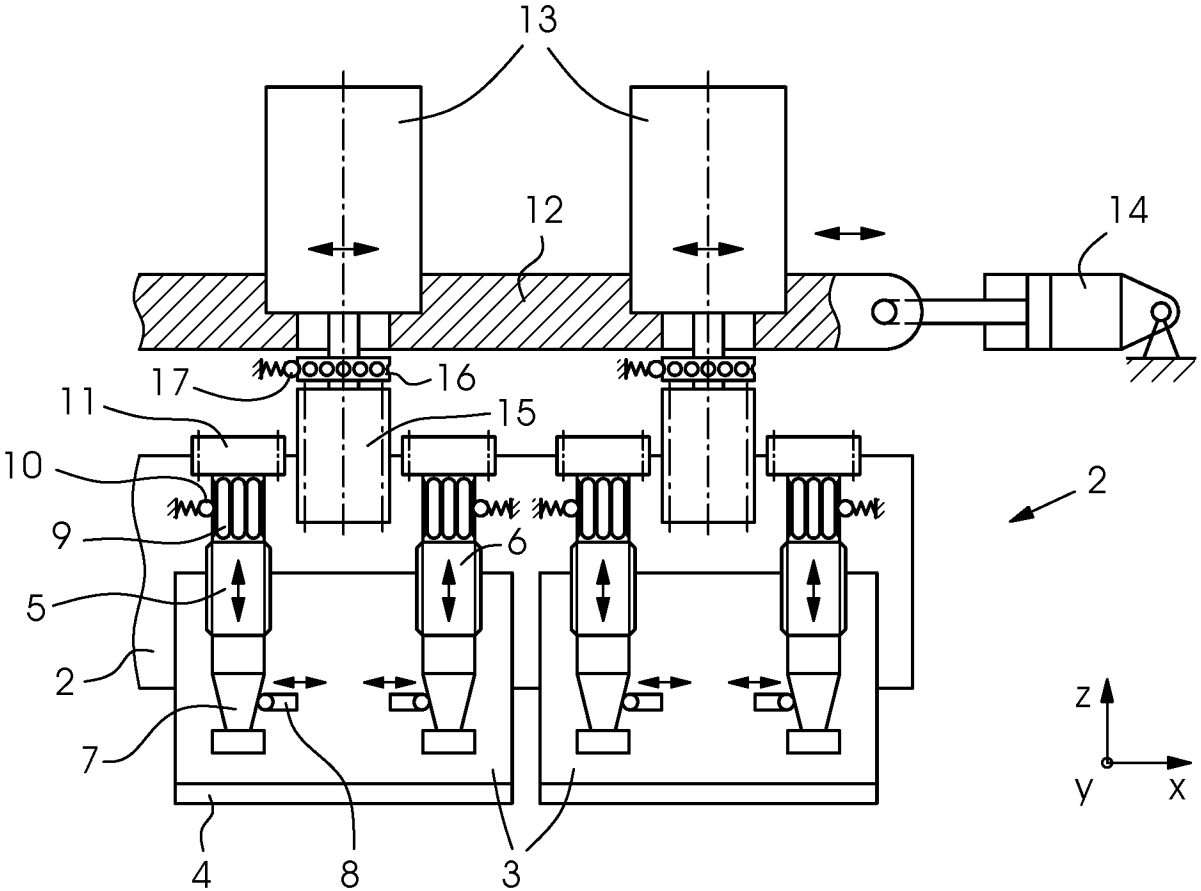
FIG. 2 is a partly fragmentary and sectional side-elevational view of a print bar of the printing machine including an adjustment device.

FIG. 2 illustrates an example of a print bar 2 including print heads 3 that are disposed in a row. Every print head 3 has a nozzle plate 4 including nozzles for jetting ink. A first screw 5 and a second screw 6 are associated with every print head 3 to adjust the print head 3 relative to the adjacent print head 3. Every screw 5, 6 adjusts a different degree of freedom of the print head 3. In the illustrated example, the first screw 5 adjusts a rotation about a z-axis z (height axis of the print bar) and the second screw 6 adjusts a translatory movement along an x-axis x (longitudinal axis of the print bar). The y-axis (transverse axis of the print bar) of the orthogonal coordinate system is parallel to the direction of printing material transport.

The screws 5, 6 are of identical construction. Therefore, only the first screw 5 will be described in detail. The screw 5 has a cone 7 that is in contact with the print head 3 through a probe 8. The cone 7 and the probe 8 together form an advance wedge transmission. When the screw 5 is screwed tighter, the cone 7 pushes the print head 3 in the required direction. The screw 5 has a series of equidistant depressions 9 that engage with a spring-loaded pressure element 10. The depressions 9 form multiple locking mechanisms. The depressions 9 are formed as grooves that are parallel to the axis of rotation of the screw 5 to permit the pressure element 10 to engage with the depressions 9 irrespective of the screwing depth of the screw 5.

In addition, the screw 5 has an adjustment gearwheel 11 with a number of teeth corresponding to the number of depressions 9. Thus the multiple locking mechanisms ensure that when the screw 5 is incrementally turned, it only stops in angular positions that correspond to meshing positions of the gearwheel 11. The gearwheel 11 may be disposed on a shaft of the screw 5 or formed on the screw 5 as a screw head. If there is no series of depressions 9, the multiple locking mechanisms may alternatively be formed by the gearwheel 11 together with the pressure element 10, which engages with tooth gaps of the gearwheel 11. This would be a space-saving alternative.

Motors 13 are disposed in a row on a crossbar or rail 12 that extends in a direction parallel to the row of screws 5, 6. The rail 12 is supported for movement in a direction parallel to the row of screws 5, 6, i.e. parallel to the x-axis, preferably by using a drive 14 such as a pneumatic cylinder. If there is no drive 14, the rail 12 or row of motors 13 may alternatively be adjusted in a direction parallel to the x-axis by hand, Every motor 13 drives the two screws 5, 6 of a different print head 3. Thus a single motor 13 per print head 3 advantageously allows the print head 3 to be adjusted in both degrees of freedom.

A motor gearwheel 15 and a locking disc 16 are supported on a shaft of the motor 13. A spring-loaded pressure element 17 engages in depressions formed in the locking disc 16. Together, the locking disc 16 and the pressure element 17 form multiple locking mechanisms. The number of teeth of the gearwheel 15 corresponds to the number of depressions in the locking disc 16. If there is no locking disc 16, the multiple locking mechanisms may be formed by the gearwheel 15 together with a pressure element 17, which engages with the tooth gaps of gearwheel 15. This would be a space-saving alternative. The multiple position locks may be completely dispensed with if the angular position of the motor 13 is established and controlled to ensure that the teeth mesh properly.

The length of the toothing of the gearwheel 15 is extended to ensure that when the screw 5 is tightened, the gearwheel 11 will not disengage from gearwheel 15 despite the axial movement of the gearwheel 11 to be driven. Thus, the gearwheel 15 is preferably a toothed shaft. If the toothing of the gearwheel 15 is of normal length, the gearwheels 11 may alternatively be constructed as toothed shafts. The axis of rotation of the gearwheel 15 is oriented to be parallel with the axis of rotation of the gearwheels 11 of the screws 5, 6. The gearwheels 11, 15 are spur gears with a straight toothing.

Figure 3A:
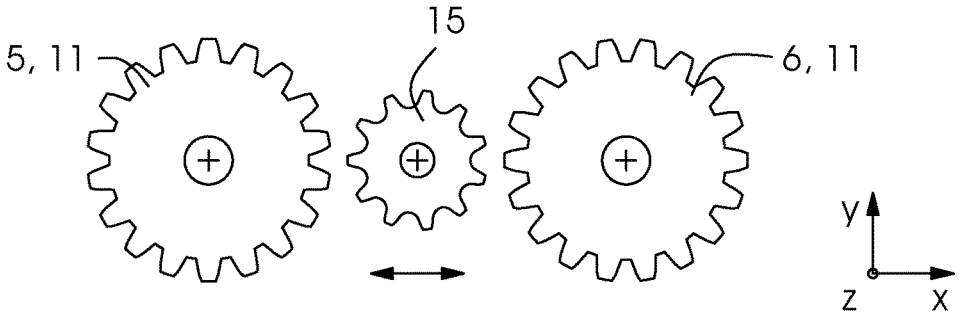
FIGS. 3A, 3B and 3C are top-plan views showing various relative positions of gearwheels of the adjustment device.
Figure 3B:
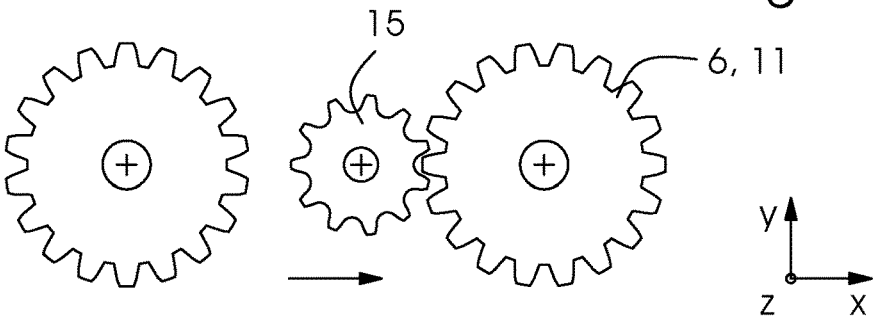
Figure 3C:
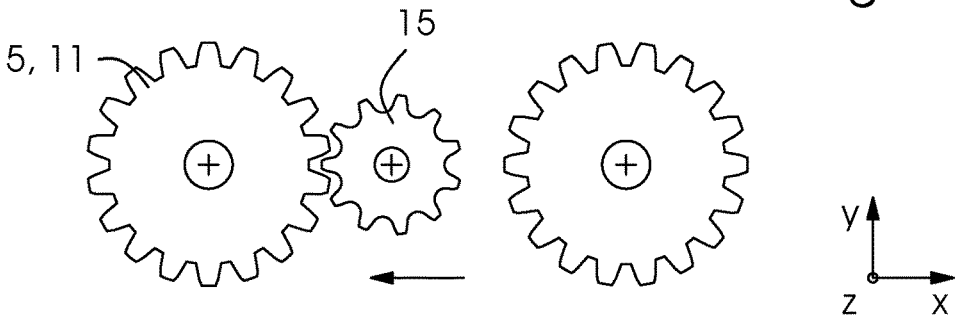

FIGS. 3A to 3C illustrate various positions of the gearwheel 15 relative to the gearwheels 11 of the screws 5, 6. These positions have been set by adjusting the rail 12. The axes of rotation or centers of all of the gearwheels 11, 15 of the print bar 2 and the adjustment device are located on a common straight line. It is irrelevant whether the motor gearwheel 15 has a smaller (as shown in FIGS. 3A-3C) or larger or the same (as shown in FIG. 2) diameter than/as the screw gearwheels 11.

FIG. 3A illustrates a central neutral position of the gearwheel 15. In this position, there is sufficient space or play between the gearwheel 15 and the two adjacent gearwheels 11 for the print head 3 to be handled and inserted into the print bar 2 without any danger of collisions with gearwheels 11. In the neutral position, the gearwheel 15 does not mesh with any other gearwheel 11 and the multiple locking mechanisms of the screws 5, 6 and the gearwheel 15 ensure that the gearwheel 15 is in an angular position relative to the gearwheels 11 of both screws 5, 6 where it is ready for tooth/gap engagement.

FIG. 3B illustrates the gearwheel 15 in a position where it has been moved to the right, meshing with the gearwheel 11 of the screw 6. FIG. 3C illustrates the gearwheel 15 in an opposite position where it has been moved to the left, meshing with the gearwheel 11 of the other screw 5. In these two positions, the motor 13 drives a respective one of screws 5 and 6. By moving the motor 13 together with its gearwheel 15, the latter is successively engaged with the two gearwheels 11 in a radial direction.

The motors 13 may operate in parallel to adjust all of the print heads 3 firstly in terms of one degree of freedom and then in terms of the other degree of freedom. For this purpose, the motors 13 may be actuated individually, for instance when one print head 3 needs to be adjusted relative to the x-axis by a different amount than another print head 3.

Figure 4:
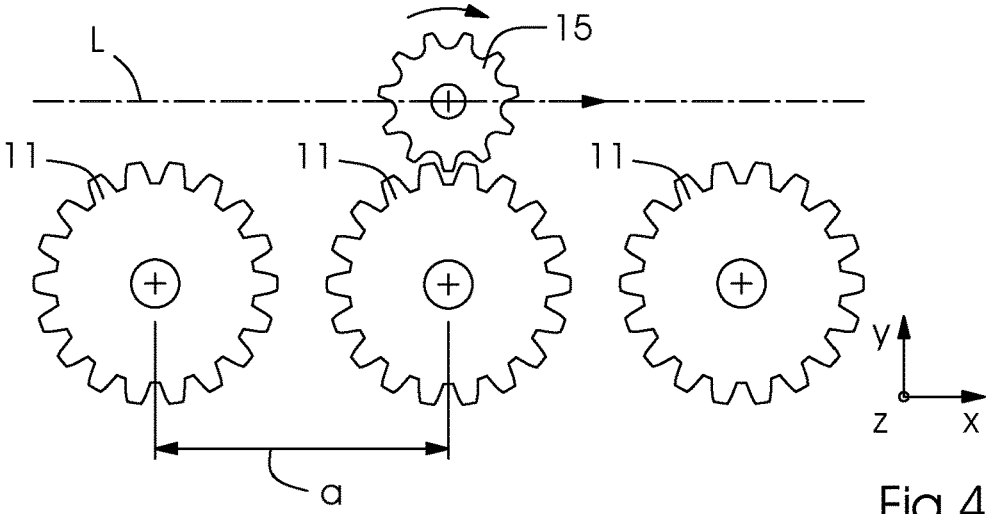
FIG. 4 is a top-plan view of a modified adjustment device.

FIG. 4 illustrates a modified version in which three or more gearwheels 11 of one or more print heads 3 are successively driven by a common motor with a gearwheel 15. In this process, the gearwheel 15 is adjusted with the rail along a line L that is parallel to a common tangent of the gearwheels 11. As the gearwheel 15 is moved along the line L from one gearwheel 11 to the other, the gearwheel 15 rotates. If a spacing a between the axes of rotation of the gearwheels 11 corresponds to a multiple of the tooth spacing between the teeth of the gearwheel 11, the gearwheel 15 moves as if it rolled on a virtual gear rack. If the spacing a does not correspond to such a multiple, the gearwheel 15 does not rotate during its entire translatory movement but only in the regions of the toothings of the gearwheels 11 and the motor of the gearwheel 15 is actuated accordingly.

The following is a summary list of reference numerals and the corresponding structure used in the above description of the invention.

LIST OF REFERENCE SYMBOLS

1 printing machine
2 print bar
3 print head
4 nozzle plate
5 first screw
6 second screw
7 cone
8 probe
9 depression
10 pressure element
11 adjustment gearwheel
12 rail
13 motor
14 drive
15 motor gearwheel
16 locking disc
17 pressure element
a spacing
L line x axis
y axis
z axis

The invention claimed is:

1. A device for adjusting print heads on a print bar for printing on printing material, the device comprising:

a rail;

motors supported for joint movement, said motors being disposed on said rail in a row extending orthogonally to a direction of transport of the printing material;

motor gearwheels each being carried by a respective one of said motors; and adjustment gearwheels, at least two of said adjustment gearwheels being disposed in a row of adjustment gearwheels;

each of said motor gearwheels being successively engageable with at least a respective two of said adjustment gearwheels;

said rail being supported for movement in parallel with said row of adjustment gearwheels.

2. The device according to claim 1, which further comprises a drive for moving said rail.

3. The device according to claim 1, which further comprises mutually parallel screws, each of said adjustment gearwheels being disposed on a respective one of said screws.

4. The device according to claim 3, wherein each of said screws has a respective cone forming an advance wedge.

5. The device according to claim 3, which further comprises a plurality of locking mechanisms for locking at least two of said adjustment gearwheels in angular positions.

6. The device according to claim 5, which further comprises pressure elements, said screws having depressions forming said plurality of locking mechanisms together with said pressure elements.

7. The device according to claim 6, wherein said adjustment gearwheels have teeth, and a number of said depressions of said plurality of locking mechanisms corresponds to a number of said teeth of at least two of said adjustment gearwheels.

8. The device according to claim 1, wherein:

said motor gearwheels supported on said motors have toothing with an axial length;

said adjustment gearwheels have toothing with an axial length; and said axial length of said toothing of every one of said motor gearwheels is greater than said axial length of said toothing of every one of said adjustment gearwheels.

9. The device according to claim 1, wherein the print heads are inkjet print heads.

* * * * *